US005435065A

United States Patent [19]

Raczykowski

[11] Patent Number: 5,435,065

[45] Date of Patent: Jul. 25, 1995

[54] CHAIN SAW DEPTH CUTTING GAUGE

[75] Inventor: Daniel G. Raczykowski, Cheney, Wash.

[73] Assignee: Unifire Power Blowers, Inc., Spokane, Wash.

[21] Appl. No.: 278,890

[22] Filed: Jul. 22, 1994

[51] Int. Cl.[6] ..... B27B 17/02

[52] U.S. Cl. ..... 30/382; 30/383

[58] Field of Search ..... 30/371, 382, 381, 383, 30/286

[56] References Cited

U.S. PATENT DOCUMENTS

| | | | |
|---|---|---|---|
| 4,063,358 | 12/1977 | Hodge | 30/382 |
| 4,833,781 | 5/1989 | Allen | 30/382 |
| 5,156,156 | 10/1992 | Ruzich | 30/382 |
| 5,269,064 | 12/1993 | Greene et al. | 30/382 |

*Primary Examiner*—Douglas D. Watts

*Attorney, Agent, or Firm*—Wells, St. John, Roberts, Gregory & Matkin

[57] ABSTRACT

A bar mounted chainsaw cutting depth gauge is described on a chain saw cutting bar for selectively covering a length of the chainsaw bar and bar tip. The gauge includes an elongated base sleeve mountable to the chainsaw bar to cover a portion of the chainsaw bar. A fastener releasably and securely mounts the base sleeve to the chainsaw cutting bar. An outer housing is slidably received over the chainsaw bar and base sleeve for sliding movement along the length thereof from a first or extended position wherein the bar tip is encased within the outer housing and a second or retracted position wherein the bar tip is exposed outward from the outer housing. The outer housing includes an outer tip with a slit formed therein for permitting passage of the chainsaw bar therethrough. A spring is operatively mounted between the base sleeve and outer housing to constantly, yieldably bias the outer housing toward the first extended position. A selected depth of cut is determined by either a pin placed between the housing and base sleeve to set a maximum or minimum cutting depth, or a clamp is used to lock the housing at a selected cutting depth.

20 Claims, 4 Drawing Sheets

33
52
45
36
39
46
49
48
47
32
30
10
31
24
23
25
20
44
27
40
43
42
41
21

CHAIN SAW DEPTH CUTTING GAUGE

TECHNICAL FIELD

The present invention relates to setting of cutting depth for chain saws and particularly to a chain saw cutting bar mounted cutting depth setting gauge.

BACKGROUND OF THE INVENTION

It is often required in the event of a building fire to ventilate the roof to allow for proper, predictable airflow through the structure. This is done at times with an axe. However the advent of lightweight, high powered chainsaws has led to roof ventilation using such saws. While the use of chainsaws for ventilation purposes simplifies and adds a degree of safety to the process, added hazards have become evident.

Chainsaw cutting chains travel at a high linear velocity and if the blade catches on a hard surface such as a nail, there is a natural tendency for the saw to kick back forcefully toward the user. Also the blade is a constant hazard when operating if left exposed.

Another problem realized is that the powerful saws will usually easily cut to a depth equal to the length of the cutting bar. This is far too great a distance, especially in most situations where it is not desired to cut through the roof rafters. It is far more typical that only the roof covering must be removed and that the rafters be left uncut in order to maintain the structural integrity of the building roof.

A need has thus become felt for a device mountable to a chainsaw that will cover the blade and thereby add a degree of operational safety, and for such device to also have the ability to set the effective depth of cut.

This need has been realized to a degree, and as a result, depth setting bar gauges have been produced. Such gauges are usually somewhat integrated with the chainsaw and are adjustable to set a working depth of cut. The nature of such gauges is that the depth, once set, remains a permanent adjustment until the gauge is intentionally reset at a different cutting depth. This means the blade tip is exposed until the adjustment is manually readjusted to a "zero" cutting depth where the blade is once again covered by the gauge. The kickback hazard and danger from the exposed blade length thus remains until the user manually resets the gauge back to the "zero" cutting depth setting.

A need thus remains for a cutting depth gauge that will function to automatically return to a "zero" depth setting when the saw is cutting to the selected depth, and that will automatically set itself to any depth short of a selected maximum cutting depth during such use.

With such a gauge, as is described and claimed below, safety is maximized even in the event of a kickback. Should the blade encounter a hard object and forcibly kick back toward the user, the automatic function of the depth gauge to "zero out" will protect the user from injury.

It is also desirable for such a gauge that can be selectively changed from the above described automatic mode to a manually secured cutting depth and that can subsequently be easily and quickly returned to a "zero" cutting depth setting.

BRIEF DESCRIPTION OF THE DRAWINGS

A preferred embodiment of the invention is described below with reference to the accompanying drawings, which are briefly described below.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figures 3, 4, 5:
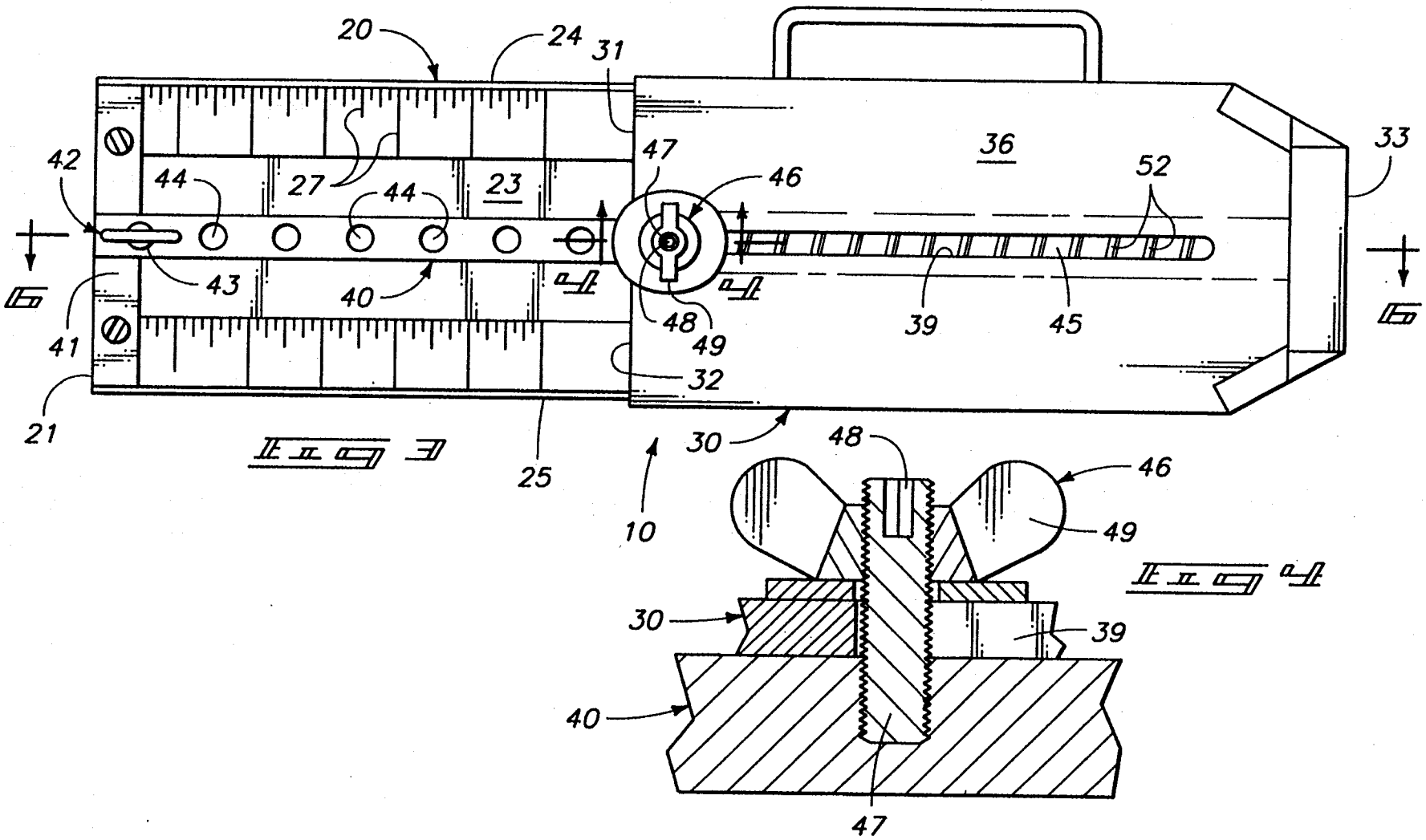
FIG. 3 is an enlarged side elevation view of the present cutting depth gauge.
FIG. 4 is an enlarged fragmented sectional view taken substantially along line 4—4 in FIG. 3.
FIG. 5 is a front or outward end view of the present cutting depth gauge.

A preferred example of the present chain saw cutting depth gauge is designated by the reference numeral 10 in the accompanying drawings. It is noted at the outset that the gauge 10 can be manufactured as shown in FIG. 3 and others, as a retrofit item to be mounted to existing chainsaw bars 13. Alternatively, the gauge 10 can be manufactured and mounted on a bar 13 by the manufacturer.

Before describing the gauge 10 in detail, a short description of a chainsaw 11 and bar 13 will be given. Such saws vary from one manufacturer to another, but typically include an internal combustion engine or motor 12 that is structured to be hand held and operated. Controls and handles not described herein are commonly provided for this purpose, at a location remote from the chain mounting bar 13 and cutting chain 14.

The chain 14 is driven by the engine or motor 12 about a course defined by the bar 13, which is typically removably mounted at a base end 15 to the engine or motor housing. The bar 13 extends outwardly to a bar tip 16 that is typically rounded. In the firefighting and rescue fields, it is the part of the bar and chain near the tip 16 that is used primarily for cutting, as the need for a cutting depth seldom exceeds more than 12 inches.

Figure 1:
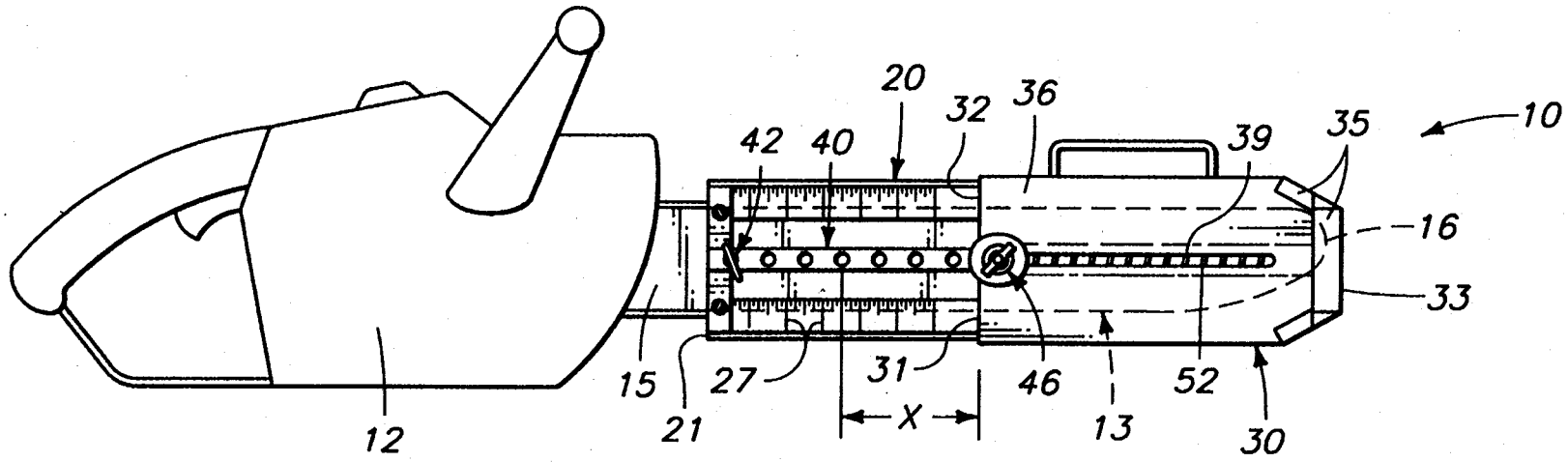
FIG. 1 is a side view of a chainsaw with the presently preferred cutting depth gauge mounted thereto.

The present gauge 10 is intended to be mounted on the chainsaw bar 13 in such a manner as shown in FIG. 1. The extended length of the gauge is selected such that it will effectively cover at least half of the bar length, and more preferably will cover even up to the full bar length. A portion of the bar length adjacent the engine or motor 12 is shown in the drawings simply to illustrate the bar and chain, but in practice could be covered by the present gauge 10. Certainly the present gauge 10 can be manufactured in various selected extended length dimensions to match the various chainsaw bar lengths typically available, or in such lengths as determined by need.

Figure 7:
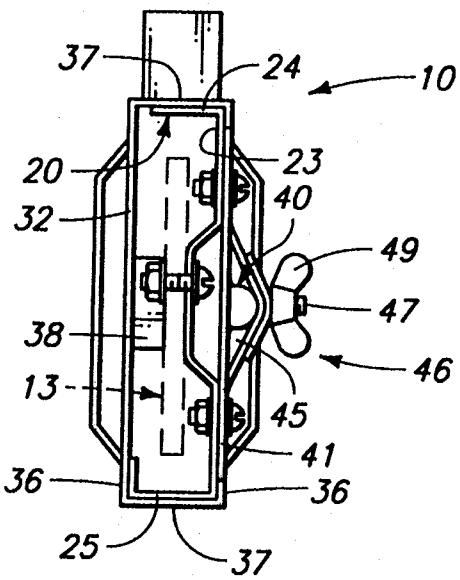
FIG. 7 is a rear or inward end view of the present depth cutting gauge.
Figure 5:
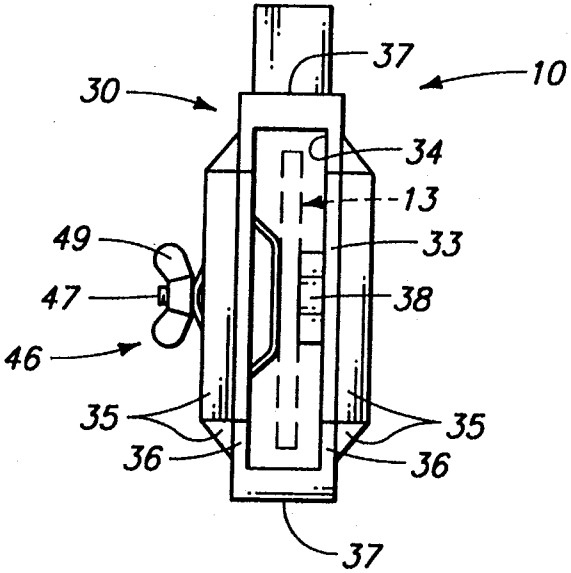

A first component of the present gauge 10 is a base sleeve 20. The term "sleeve" is used herein apart from the common meaning which infers a closed "tube" shape. Rather the sleeve 20 is, as shown in FIG. 7, of a reversed "C" shape that is elongated somewhat in the form of a channel.

The sleeve 20, as are other components of the present gauge 10, is formed using common stamping, bending and forming techniques. The preferred material is zinc coated or stainless sheet steel, the thickness of which will vary with the size of the unit required but which is selected to lend rigidity and durability to the various components.

Figure 6:
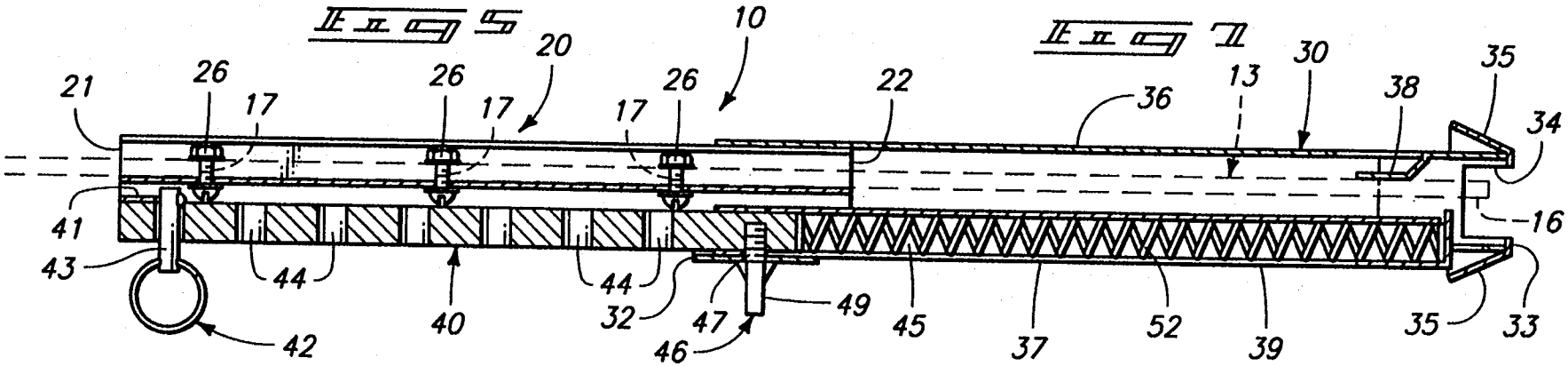
FIG. 6 is a longitudinal sectional view taken substantially along line 6—6 in FIG. 3.
Figure 8:
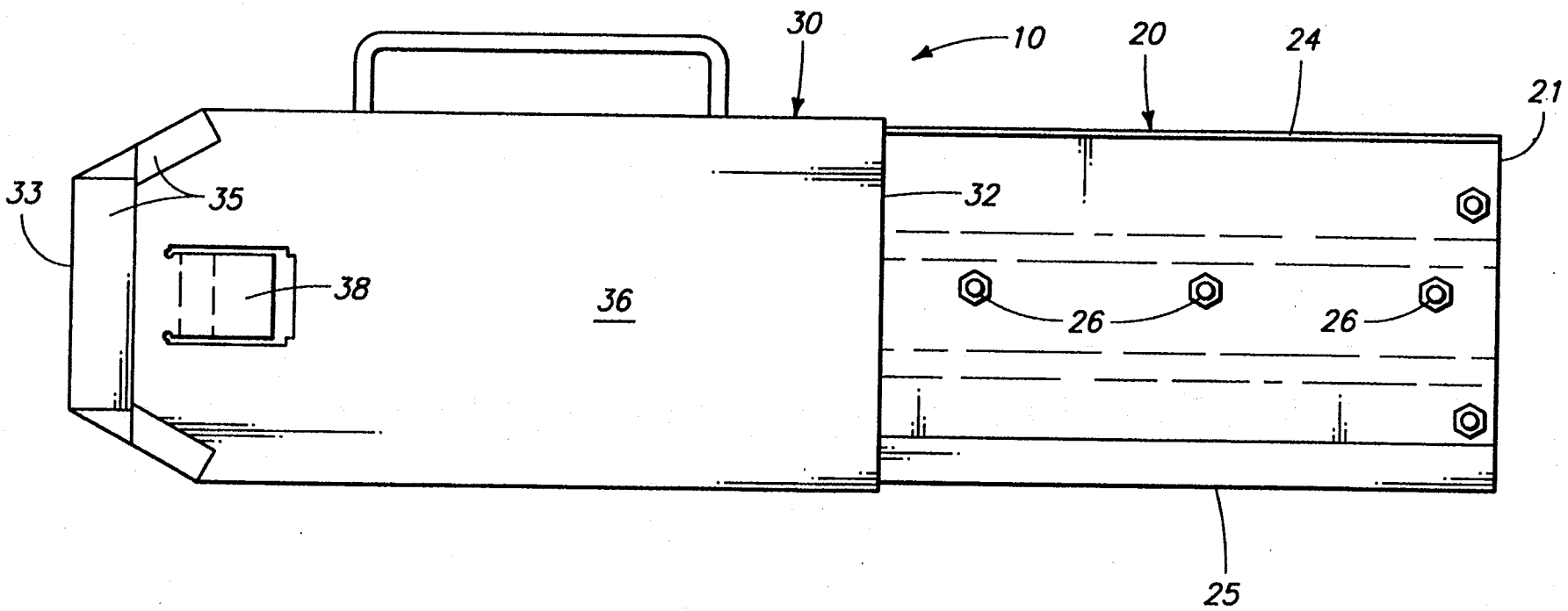
FIG. 8 is an elevation view showing a side of the present depth cutting gauge opposite that shown in FIG. 3.

The sleeve 20 is elongated, extending from an inboard end 21 longitudinally to an outboard end 22 (FIG. 6). The length is selected to be no more than half the length of the chainsaw bar 13. It includes a side wall 23 and opposed top and bottom walls 24, 25 respectively. Walls 24, 25 extend over the bar 13 and chain 14 as shown in FIG. 7.

Sleeve 20 also includes a longitudinal indentation that is apertured to receive at least one and more preferably three fasteners 26 for mounting the sleeve securely to the bar 13. To this end, the bar 13 is provided with drilled holes 17 (FIG. 6) strategically located along its length.

The location of the mounting holes 17 is determined in relation to the bar length and the extended length of the gauge 10. They may be drilled by the manufacturer, or by the installer, using an appropriate template (not shown).

Calibrated indicia 27 is provided along the length of the sleeve 20, preferably on the side wall 23. The calibrations are in increments set to indicate a cutting depth in relation to a reference surface 31 on an outer housing 30 that will be described in greater detail below.

The indicia 27 may be supplied as adhesive backed strips, preferably with a light reflective or luminescent faces to simplify reading the calibrations in low light situations. Gradations in inches and fractions thereof have been found to be most useful for firefighting purposes.

Figure 2:
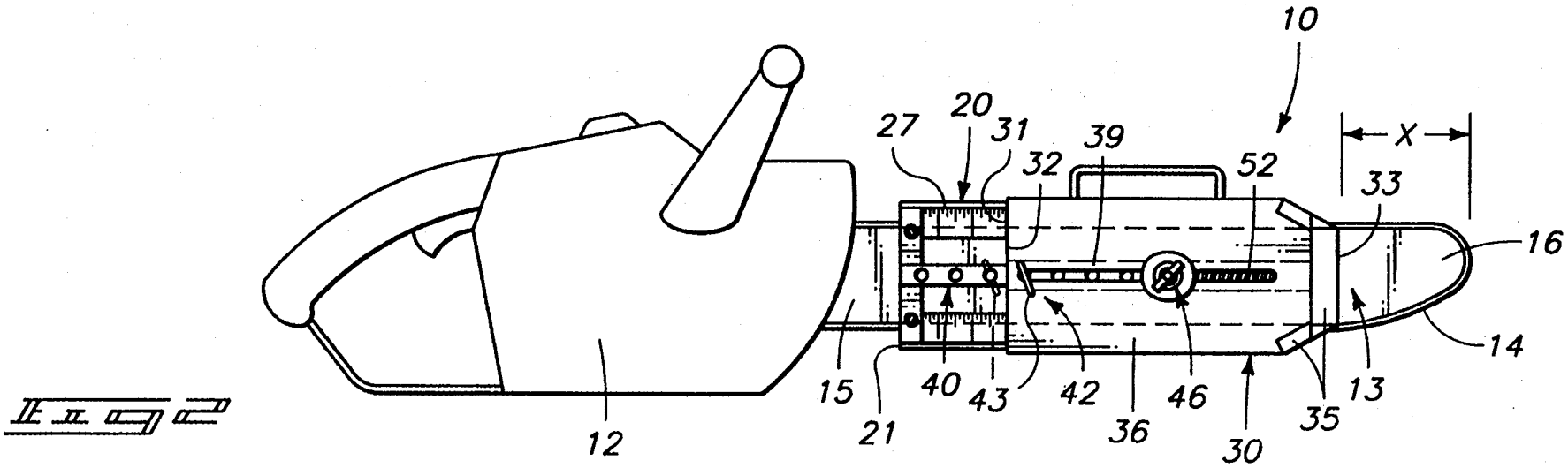
FIG. 2 is a view similar to FIG. 1 only showing the cutting depth gauge set at a desired cutting depth.

The outer housing 30 briefly referred to above is slidably received over the base sleeve 20 and slides thereon between a selected first or extended position (FIG. 1) and a selected inward second or retracted position, one of which is exemplified by FIG. 2.

Housing 30 is elongated, extending from an inward end 32 (coincidental with the reference surface 31) to a tip 33 at an outward end. The tip 33 includes an open slit 34 to allow passage of the bar tip 16 and chain 14.

Housing 30 includes angled guide surfaces 35 adjacent the tip 16 to assist the user in starting plunging cuts and for holding the saw at prescribed angular orientations during use. The surfaces 35 also serve to reinforce the tip 33 against abuse and wear during such use. The surface immediately adjacent the slit 34, however is flat and substantially perpendicular to the bar length to guide vertical cuts.

Housing 30 is formed along its length by opposed side walls 36, joined by top and bottom walls 37. Together the walls 36 and 37 enclose a length of the base sleeve 20 in a loose, longitudinally slidable relation. The walls 36, 37 also enclose the bar 13 and chain 14.

A guide surface 38 (FIGS. 5–8) is advantageously formed from one of the walls 36 and is bent inwardly to slidably engage the bar 13. Surface 38 serves to hold the housing tip 33 away from undesired contact with the bar 13 and chain 14.

An elongated pin receiving slot 39 is formed in the housing, in alignment with a depth gauge rod 40 to be described in detail below. The slot 39 is formed in an opposite one of the walls 36 and extends from a closed end adjacent the inward housing end 32 to a closed end adjacent the tip 33.

The depth gauge rod 40 is shown in detail in FIGS. 3 and 6. It is rigidly mounted at one end by a bracket 41 to the base sleeve 20, adjacent the inboard sleeve end 21. Rod 40 is thus stationary on the sleeve 20, which in turn is stationary on the bar 13.

Rod 40 extends longitudinally from the bracket 41 to be slidably received within a way or elongated pocket 45 (FIGS. 7, 8), formed along the length of outer housing 30. Spaced apertures 44 are provided along the length of the rod 40. The spacing of the apertures 44 is related to the spacing of the indicia 27, in increments preferably in inches.

A stop 42 preferably in the form of a removable pin 43 is provided to be received in any selected one of the apertures 44, and through the slot 39.

To set the housing to a preferred cutting depth (shown at X in FIGS. 1 and 2), the housing is slid back over the base sleeve 20 and bar 13 until the inward closed end of the slot 39 comes into alignment with the chosen aperture 44. Next the pin 43 is inserted through the slot 39 and selected aligned aperture 44. The pin 43 now acts as a stop, preventing the housing from sliding outwardly toward the tip.

Alternatively, the pin can be placed in a selected aperture 44 immediately inward of the housing inward end 32. This arrangement is exemplified by dashed lines in FIG. 2. The pin 43 now will function as a stop to limit inward travel of the housing beyond a selected cutting depth at which the end 32 of the housing will come into contact with the pin 43. This usage of the stop pin 43 will allow the housing 30 to slide back outwardly to the first or fully extended position (FIG. 1) when the saw is pulled from the cut or is not otherwise operational. In other words the pin 43 will allow the housing to slide inwardly to the maximum cutting depth at which the end 32 of the housing will come into contact with the pin 43. It will also permit the housing slide back toward the bar tip 16 to cover the blade at all cutting depths from zero to the maximum depth determined by the pin placement.

In addition to the stop pin 43, selective adjustment of the cutting depth can be controlled using a friction clamp 46 (FIGS. 3 and 4). The clamp enables the housing to be drawn back to a selected cutting depth and temporarily locked in position regardless of saw operation.

The clamp 46 is advantageously comprised of a threaded stud 47 threadably engaged with the rod 40. The exposed end of the stud 47 is provided with a hex socket 48 for receiving an allen wrench (not shown) to be used for assembling and disassembling the gauge 10. Removal of the stud 47 will permit the housing 30 to be slid completely off the base sleeve and rod. It is preferred, however, that the stud 47 be secured to the bar, so is treated during assembly (as are other threaded fasteners in the gauge 10) with a commercially available thread adhesive.

The stud 47 extends through the slot 39 to receive a nut, preferably a wing nut 49. The wing nut 49 can thus be selectively tightened or loosened to increase or decrease clamping force against the engaged part housing. This has the effect of either locking the housing in stationary relation to the base sleeve 20 or allowing the housing to slide freely within the longitudinal confines of the slot 39 formed therein.

Thus the wing nut 49 can be used to lock the housing in any one of a substantially infinite number of cutting depth positions between the extremes set by the slot 39 length. The selected depth of cut will be maintained until the wing nut is loosened.

The housing 30 is constantly biased to its first or fully extended (FIG. 1) position by a spring 52. The spring 52 is, in the preferred example shown, a simple helical wire-wound compression spring, though other types might be envisioned by those of skill in the art. For example, a tension spring (not shown) might also be used to a similar effect, connecting the housing and base in such a manner to pull the housing toward the first or extended position.

The preferred compression spring 52 is mounted within the way or long pocket 45 within the outer housing 30. It extends from one end abutting the outward end of the rod 40 to an appropriate abutment surface (FIG. 6) spanning the pocket 45 adjacent the housing tip 33.

The spring 52, and rod 40 are aligned axially so that the spring 52 can act freely against the stationary rod to yieldably urge the housing 30 to its first or extended position. The spring will compress as the housing is slid inwardly to expose the bar 13 and chain 14. When the compressing force is released, the spring will automatically react to push the housing back out to the first or extended position.

Thus in a plunge cut, the user can simply press the housing tip 33 against the workpiece and continue pushing to force the cutting chain and bar to start the cut. The housing tip 33 will stay in position against the workpiece, sliding inwardly over the base sleeve as the cut deepens. Then, as the saw is withdrawn, (unless the pin 43 or clamp 46 is in use) the housing 30 will remain in contact with the workpiece as the bar and base sleeve move back out.

When the saw is fully withdrawn from the cut, even if the withdrawal happens quickly as in a kickback, the housing will already be in or will quickly return to its first or extended position, enclosing the bar tip 16.

Use of the present gauge 10 will be described in terms of a specific example, say as when a user wishes to set a three inch cutting depth. To select a three inch cutting depth, the user simply slides the housing inward until the reference surface 31 aligns with a corresponding one of the indicia 27, indicating a three inch depth of cut.

The user then decides which mode (a. b. or c. described below) is wished for operation.

In mode a., if the pin 43 is placed through the slot 39 and into an aperture 44 of the rod currently aligned with the slot closed end, the resulting set-up will allow for a minimum depth of cut at three inches.

In mode b., if the pin 43 is placed through an aperture 44 currently aligned with the inward housing end 32, a three inch maximum depth of cut is set.

In mode c., if the clamp 46, rather than the pin 43 is used to lock the housing 30 to the base sleeve 20, a constant three inch depth of cut is attained. That selected depth will remain until the wing nut 49 is loosened to allow the spring to push the housing 30 back to its first or extended position.

The cut is started by forcing the moving cutting chain at or adjacent the bar tip 26 into the workpiece. The cut is deepened until stopped by the gauge 10.

Then when the cut is finished or the saw is otherwise withdrawn, depending on the mode selected, the housing will either a. slide to the minimum depth selected; b. slide back to the fully extended position; or c. stay in the selected depth of cut position until the wing nut 49 is loosened.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A bar mounted chainsaw cutting depth gauge for mounting to a chain saw cutting bar having a base end mountable to a chainsaw motor and an opposed bar tip, for selectively covering a length of the chainsaw bar and bar tip, comprising:

an elongated base sleeve extending from an inboard end to an outboard end, for reception over and encasing a portion of the chainsaw bar with the inboard end positioned toward the base end of the chainsaw bar and the outboard end positioned toward the bar tip;

a fastener for releasably and securely mounting the base sleeve to the chainsaw cutting bar;

an outer housing for loose reception over the chainsaw bar and mounted to the base sleeve for sliding movement along the length thereof from a first position wherein the bar tip is encased within the outer housing and a second position wherein the bar tip is exposed outward from the outer housing a depth gauge rod mounted between the base sleeve and said outer housing stationary with respect to one of the base sleeve or outer housing and slidably received by the other one of the base sleeve or outer housing;

the outer housing including an outer tip with a slit formed therein for permitting passage of the chainsaw bar therethrough; and a spring operatively mounted between the base sleeve and outer housing, biasing the outer housing toward the first position.

2. A bar mounted chainsaw cutting depth gauge as claimed by claim 1, further comprising:

the depth gauge rod being mounted to the base sleeve and slidably mounted to the outer housing;

a series of spaced apertures defined along the depth gauge rod, and a stop comprised of a pin releasably receivable within any one of the pin receiving apertures, for abutment with the outer housing to thereby limit the relative longitudinal positions of the base sleeve and outer housing.

3. A bar mounted chainsaw cutting depth gauge as claimed by claim 1, further comprising:

cutting depth indicia on the base sleeve and a reference surface on the outer housing adjacent the indicia.

4. A bar mounted chainsaw cutting depth gauge as claimed by claim 1, further comprising:

a pin receiving slot in the outer housing;

wherein the depth gauge rod is mounted to the base sleeve and slidably mounted to the outer housing and having spaced pin receiving apertures formed therein substantially aligned with the pin receiving slot;

a stop comprised of a pin releasably receivable within any one of the pin receiving apertures, for abutment with the outer housing to thereby limit the relative longitudinal positions of the base sleeve and outer housing.

5. A bar mounted chainsaw cutting depth gauge as claimed by claim 1, further comprising:

a pin receiving slot in the outer housing;

wherein the depth gauge rod is mounted to the base sleeve and slidably mounted to the outer housing and having spaced pin receiving apertures formed therein substantially aligned with the pin receiving slot;

a stop comprised of a pin releasably receivable within any one of the pin receiving apertures, for abutment with the outer housing to thereby limit the relative longitudinal positions of the base sleeve and outer housing; and a friction clamp mounted to the depth gauge rod and slidably received through the longitudinal slot for frictionally clamping the outer housing to the depth gauge rod to thereby enable selective relative longitudinal positioning of the outer housing and base sleeve, and consequent distance between the outer housing and the chain saw bar tip.

6. A bar mounted chainsaw cutting depth gauge as claimed by claim 1, further comprising:

a pin receiving slot in the outer housing;

wherein the depth gauge rod is mounted to the base sleeve and slidably mounted to the outer housing and having spaced pin receiving apertures formed therein substantially aligned with the pin receiving slot;

a stop comprised of a pin releasably receivable within any one of the pin receiving apertures, for abutment with the outer housing to thereby limit the relative longitudinal positions of the base sleeve and outer housing; and a friction clamp comprised of a threaded stud mounted to the depth gauge rod and slidably received through the longitudinal pin receiving slot and a nut threadably engaged on the stud for frictionally clamping the outer housing to the depth gauge rod to thereby enable selective relative longitudinal positioning of the outer housing and base sleeve, and consequent distance between the outer housing and the chain saw bar tip.

7. A bar mounted chainsaw cutting depth gauge as claimed by claim 1, further comprising:

a pin receiving slot in the outer housing;

wherein the depth gauge rod is mounted to the base sleeve and slidably mounted to the outer housing and having spaced pin receiving apertures formed therein substantially aligned with the pin receiving slot;

a stop comprised of a pin releasably receivable within any one of the pin receiving apertures, for abutment with the outer housing to thereby limit the relative longitudinal positions of the base sleeve and outer housing; and a friction clamp comprised of a threaded stud threadably secured to the depth gauge rod and slidably received through the longitudinal pin receiving slot and a nut threadably engaged on the stud for frictionally clamping the outer housing to the depth gauge rod to thereby enable selective relative longitudinal positioning of the outer housing and base sleeve, and consequent distance between the outer housing and the chain saw bar tip.

8. A bar mounted chainsaw cutting depth gauge as claimed by claim 1, further comprising:

the depth gauge rod being mounted to the base sleeve and slidably mounted to the outer housing; and wherein the spring is a compression spring mounted between the base sleeve and outer housing and oriented longitudinally such that the spring will compress as the outer housing is moved longitudinally toward the inboard end of the base sleeve.

9. A bar mounted chainsaw cutting depth gauge as claimed by claim 1, further comprising:

the depth gauge rod being mounted to the base sleeve and slidably mounted to the outer housing;

wherein the outer housing includes a longitudinal slot formed therein and aligned with the depth gauge rod; and a friction clamp mounted to the depth gauge rod and slidably received through the longitudinal slot for frictionally clamping the outer housing to the depth gauge rod to thereby enable selective relative longitudinal positioning of the outer housing and base sleeve, and consequent distance between the outer housing and the chain saw bar tip.

10. A bar mounted chainsaw cutting depth gauge as claimed by claim 1, further comprising:

the depth gauge rod being mounted to the base sleeve and slidably mounted to the outer housing;

wherein the outer housing includes a longitudinal slot formed therein and aligned with the depth gauge rod; and a friction clamp comprised of a threaded stud threadably secured to the depth gauge rod and slidably received through the longitudinal pin receiving slot and a nut threadably engaged on the stud for frictionally clamping the outer housing to the depth gauge rod to thereby enable selective relative longitudinal positioning of the outer housing and base sleeve, and consequent distance between the outer housing and the chain saw bar tip.

11. A chainsaw bar and chainsaw cutting depth gauge for mounting to a chain saw, comprising a cutting bar having a base end mountable to a chainsaw motor and an opposed bar tip;

an elongated base sleeve extending from an inboard end to an outboard end received over and encasing a portion of the chainsaw bar with the inboard end positioned toward the base end of the chainsaw bar and the outboard end positioned toward the bar tip;

wherein the chainsaw bar includes a mounting hole formed therein;

a fastener on the base sleeve and received through the mounting hole for releasably and securely mounting the base sleeve to the chainsaw cutting bar;

an outer housing slidably received over the chainsaw bar and mounted to the base sleeve for sliding movement along the length thereof from a first position wherein the bar tip is encased within the outer housing and a second position wherein the bar tip is exposed outward from the outer housing a depth gauge rod mounted between the base sleeve and said outer housing stationary with respect to one of the base sleeve or outer housing and slidably received by the other one of the base sleeve or outer housing;

the outer housing including an outer tip with a slit formed therein for permitting passage of the chainsaw bar therethrough; and a spring operatively mounted between the base sleeve and outer housing, biasing the outer housing toward the first position.

12. A chainsaw bar and chainsaw cutting depth gauge for mounting to a chain saw as claimed by claim 11, further comprising:

the depth gauge rod being mounted to the base sleeve and slidably mounted to the outer housing; and a series of spaced apertures defined along the depth gauge rod, and a stop comprised of a pin releasably receivable within any one of the pin receiving apertures, for abutment with the outer housing to thereby limit the relative longitudinal positions of the base sleeve and outer housing.

13. A chainsaw bar and chainsaw cutting depth gauge for mounting to a chain saw as claimed by claim 11, further comprising:

cutting depth indicia on the base sleeve and a reference surface on the outer housing adjacent the indicia.

14. A chainsaw bar and chainsaw cutting depth gauge for mounting to a chain saw as claimed by claim 11, further comprising:

a pin receiving slot in the outer housing;

wherein the depth gauge rod is mounted to the base sleeve and slidably mounted to the outer housing and having spaced pin receiving apertures formed therein substantially aligned with the pin receiving slot;

a stop comprised of a pin releasably receivable within any one of the pin receiving apertures, for abutment with the outer housing to thereby limit the relative longitudinal positions of the base sleeve and outer housing.

15. A chainsaw bar and chainsaw cutting depth gauge for mounting to a chain saw as claimed by claim 11, further comprising:

a pin receiving slot in the outer housing;

wherein the depth gauge rod is mounted to the base sleeve and slidably mounted to the outer housing and having spaced pin receiving apertures formed therein substantially aligned with the pin receiving slot;

a stop comprised of a pin releasably receivable within any one of the pin receiving apertures, for abutment with the outer housing to thereby limit the relative longitudinal positions of the base sleeve and outer housing; and a friction clamp mounted to the depth gauge rod and slidably received through the longitudinal slot for frictionally clamping the outer housing to the depth gauge rod to thereby enable selective relative longitudinal positioning of the outer housing and base sleeve, and consequent distance between the outer housing and the chain saw bar tip.

16. A chainsaw bar and chainsaw cutting depth gauge for mounting to a chain saw as claimed by claim 11, further comprising:

a pin receiving slot in the outer housing;

wherein the depth gauge rod is mounted to the base sleeve and slidably mounted to the outer housing and having spaced pin receiving apertures formed therein substantially aligned with the pin receiving slot;

a stop comprised of a pin releasably receivable within any one of the pin receiving apertures, for abutment with the outer housing to thereby limit the relative longitudinal positions of the base sleeve and outer housing; and a friction clamp comprised of a threaded stud mounted to the depth gauge rod and slidably received through the longitudinal pin receiving slot and a nut threadably engaged on the stud for frictionally clamping the outer housing to the depth gauge rod to thereby enable selective relative longitudinal positioning of the outer housing and base sleeve, and consequent distance between the outer housing and the chain saw bar tip.

17. A chainsaw bar and chainsaw cutting depth gauge for mounting to a chain saw as claimed by claim 11, further comprising:

a pin receiving slot in the outer housing;

wherein the depth gauge rod is mounted to the base sleeve and slidably mounted to the outer housing and having spaced pin receiving apertures formed therein substantially aligned with the pin receiving slot;

a stop comprised of a pin releasably receivable within any one of the pin receiving apertures, for abutment with the outer housing to thereby limit the relative longitudinal positions of the base sleeve and outer housing; and a friction clamp comprised of a threaded stud threadably secured to the depth gauge rod and slidably received through the longitudinal pin receiving slot and a nut threadably engaged on the stud for frictionally clamping the outer housing to the depth gauge rod to thereby enable selective relative longitudinal positioning of the outer housing and base sleeve, and consequent distance between the outer housing and the chain saw bar tip.

18. A chainsaw bar and chainsaw cutting depth gauge for mounting to a chain saw as claimed by claim 11, further comprising:

the depth gauge rod being mounted to the base sleeve and slidably mounted to the outer housing; and wherein the spring is a compression spring mounted between the base sleeve and outer housing and oriented longitudinally such that the spring will compress as the outer housing is moved longitudinally toward the inboard end of the base sleeve.

19. A chainsaw bar and chainsaw cutting depth gauge for mounting to a chain saw as claimed by claim 11, further comprising:

the depth gauge rod being mounted to the base sleeve and slidably mounted to the outer housing;

wherein the outer housing includes a longitudinal slot formed therein and aligned with the depth gauge rod; and a friction clamp mounted to the depth gauge rod and slidably received through the longitudinal slot for frictionally clamping the outer housing to the depth gauge rod to thereby enable selective relative longitudinal positioning of the outer housing and base sleeve, and consequent distance between the outer housing and the chain saw bar tip.

20. A chainsaw bar and chainsaw cutting depth gauge for mounting to a chain saw as claimed by claim 11, further comprising:

the depth gauge rod being mounted to the base sleeve and slidably mounted to the outer housing;

wherein the outer housing includes a longitudinal pin receiving slot formed therein and aligned with the depth gauge rod; and a friction clamp comprised of a threaded stud threadably secured to the depth gauge rod and slidably received through the longitudinal pin receiving slot and a nut threadably engaged on the stud for frictionally clamping the outer housing to the depth gauge rod to thereby enable selective relative longitudinal positioning of the outer housing and base sleeve, and consequent distance between the outer housing and the chain saw bar tip.

* * * * *